US006929589B1

(12) United States Patent
Bruggemann et al.

(10) Patent No.: US 6,929,589 B1
(45) Date of Patent: Aug. 16, 2005

(54) ATHLETIC EXERCISER PULLING DEVICE

(76) Inventors: Thomas J. Bruggemann, 20600 Dumont St., Woodland Hills, CA (US) 91364; Michael J. Ehrlich, 15305 Juniper Ct., Pine Mountain Club, CA (US) 93222

( * ) Notice: Subject to any disclaimer, the term of this patent is extended or adjusted under 35 U.S.C. 154(b) by 0 days.

(21) Appl. No.: 10/943,466

(22) Filed: Sep. 17, 2004

Related U.S. Application Data

(60) Provisional application No. 60/572,415, filed on May 20, 2004.

(51) Int. Cl.[7] ..... A63B 69/00
(52) U.S. Cl. ..... 482/138; 482/121; 482/127; 482/904
(58) Field of Search ..... 482/114–116, 121, 482/124, 126, 127, 129, 148, 131, 133, 136, 482/904, 907, 908

(56) References Cited

U.S. PATENT DOCUMENTS 5,505,681 A * 4/1996 Bruggemann ..... 482/127
5,580,338 A * 12/1996 Scelta et al. ..... 482/62
6,482,138 B1 * 11/2002 Nelson ..... 482/118

* cited by examiner

*Primary Examiner*—Glenn E. Richman
(74) *Attorney, Agent, or Firm*—Monty Koslover

(57) ABSTRACT

An improved device for athletic exercise by pulling at a resisting force. The device consists of a number of spring housing assemblies that are stacked and clamped in a column with at least one pulley wheel assembly to which a cord and pull handle is attached. A grooved metal shaft is disposed throughout the column longitudinal axis to drive all the constant-force spring assemblies which are stacked inside the device when the pulley wheel is caused to rotate. A person uses the device by first selecting which spring assemblies he wants to produce a particular resisting force level, by pushing separate selector levers, one for each spring. He then pulls at the pull handle to experience the chosen resisting force. The device design allows a user the choice of many resisting force levels, using only a small number of spring assemblies. The device is small, light in weight and conveniently shaped for easy attachment to any suitable restraining object.

12 Claims, 6 Drawing Sheets

ATHLETIC EXERCISER PULLING DEVICE

THIS APPLICATION CLAIMS THE BENEFIT OF PROVISIONAL APPLICATION NO. 60/572,415 FILED May 20, 2004

BACKGROUND OF THE INVENTION

1. Field of the Invention

This invention relates to equipment used for athletic exercise, and more particularly, to portable devices used to exercise and strengthen the muscles by pulling.

2. Background

A portable athletic exerciser pulling device was invented earlier and is described in U.S. Pat. No. 5,505,681 by Bruggemann, who is one of the present inventors. This patented device consists of a small cylindrical housing enclosure containing a number of constant force, circular wound spring assemblies; and includes a cord-wound pulley wheel with a pull handle, that is molded to the enclosure and an attached force selector mechanism. The selector is used to manually select the number of spring assemblies to be engaged by the pulley, by inserting and moving a splined rod axially to connect in turn with the axially stacked spring assemblies.

When the pull handle is pulled, the device housing rotates around its cylindrical axis as do all the spring assemblies inside the housing. However, the total resisting force felt by a user is determined by the number of spring assemblies selected, as well as their individual constant force ratings.

If five spring assemblies are contained in the housing, then the maximum number of resisting force levels available to a user is also five. This is due to the sequential method of spring assembly selection employed by the device.

While the device described above has performed admirably and has been well received by users, the inventors believe that the number of resistance force levels made available by the device is unnecessarily limited, and the device remains more costly to produce than desired. There is, therefore, a need to improve upon the design of the device to extend the device versatility and at the same time, decrease the cost of the device.

SUMMARY OF THE INVENTION

The invention is an improvement of an exerciser pulling device which is described in U.S. Pat. No. 5,505,681 by Bruggemann. The invention is a small device which may be fastened to any suitable immovable object, and having a pull handle attached to a cord which is wrapped around a pulley wheel inside the device. The device comprises a plurality of spring housing assemblies that are stacked and clamped in a column with at least one pulley wheel assembly; and a grooved metal shaft that is disposed throughout the column longitudinal axis, engaging the hubs of all constant-force spring assemblies which are stacked inside the housing assemblies and engaging the pulley wheel hub. Means are provided for user manual selection of any individual spring assembly through slots in the side of the housing assemblies. Selection causes a selected spring assembly to generate a resisting force when the pull handle is pulled away from the device by an exerciser.

An advantage and improvement is that any one of the spring assemblies and any combination of the available spring assemblies can be selected by an exerciser, permitting a large number of force settings to be available for even relatively few total spring assemblies in a device.

Another advantage is the improved convenience of being able to fasten the device directly to any convenient immovable object without need for clamps.

Yet another advantage is the low cost of the invention device as compared with earlier devices.

Accordingly, it is a principal object of this invention to provide a large variety of resisting force settings available to a user of the device.

Another object is to improve the earlier device by greatly simplifying the device construction and reducing the number of parts required.

Further objects and advantages of the invention will be apparent from studying the following portion of the specification, the claims and the attached drawings.

DESCRIPTION OF THE PREFERRED EMBODIMENT

Figure 1:
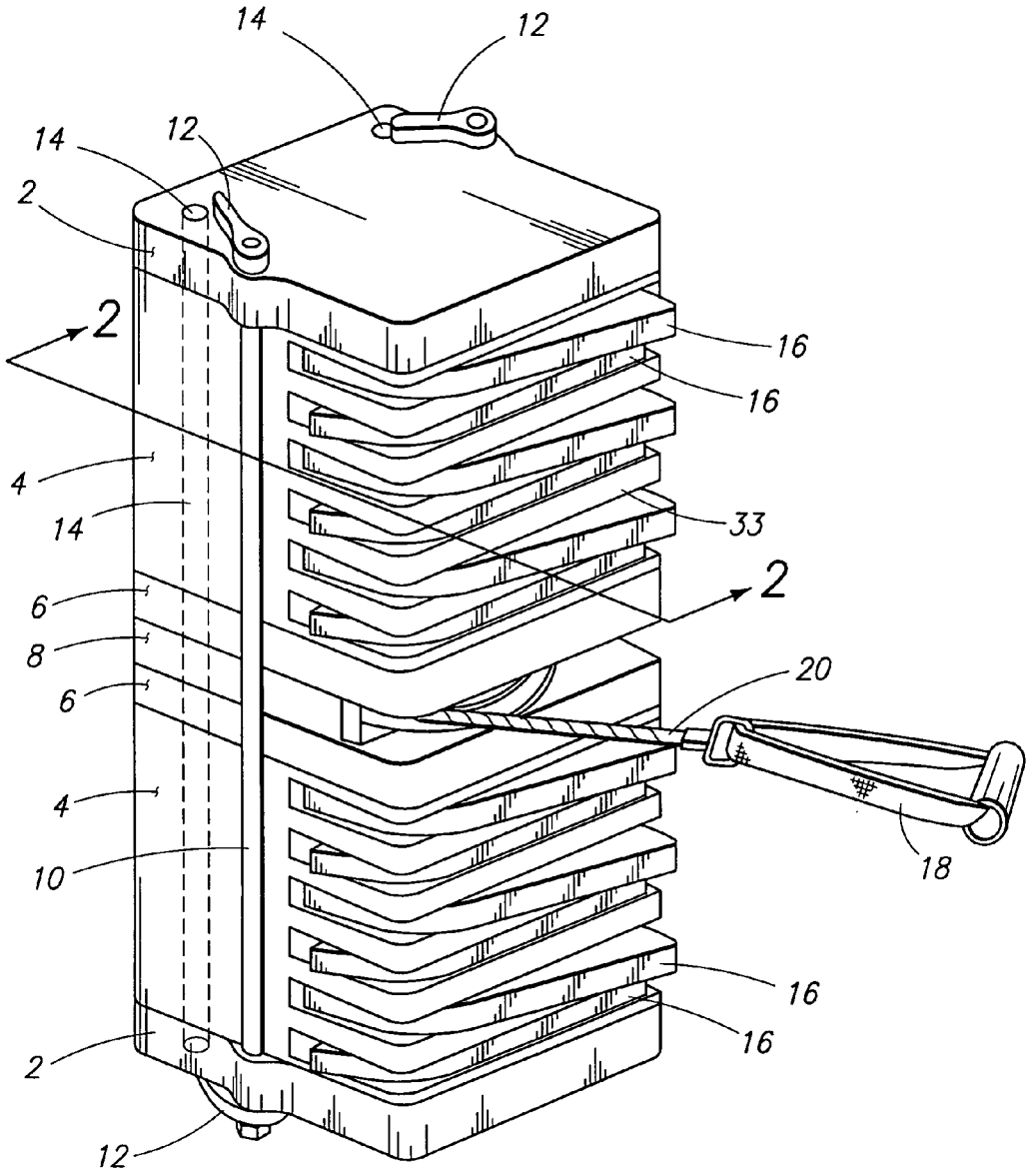
FIG. 1 is a perspective view of a preferred embodiment of an exerciser pulling device according to the present invention.

Referring particularly to the drawings, there is shown in FIG. 1, a preferred embodiment of an exerciser pulling device according to the present invention. The exerciser pulling device is simply constructed, and comprises one or more spring housing assemblies that are stacked in-line with one or more pulley wheel assemblies. Pulling a cord that is attached to a pulley wheel, produces an opposing, resisting force that is created by selected spring assemblies in each spring housing assembly.

The device is designed to be clamped or fastened to a fixed object such as a desk and used for manual pulling exercise. If needed for fastening, metal rings may be attached to the device end caps 2 for this purpose. A pull handle 18 is attached to the pulley wheel cord 20 and normally hangs down when not in use. If the device was being used for exercise, its pull handle 18 would be extended outwards as illustrated in FIG. 1, In the preferred embodiment shown in FIG. 1, a pulley wheel assembly 8 is shown sandwiched axially between two identical, spring housing assemblies. Each spring housing assembly is a capped, spring housing member 4 that contains a number of axially stacked, constant-force spring assemblies 24. Lateral slots are cut in one longitudinal face of the spring housing member 4 which is designated as a control face 33. These slots are arranged to be each co-planar with a spring assembly and to accommodate selector levers 16, one in each slot. The levers are employed to separately select and engage any individual spring assembly 24 to resist a pull exerted by a user.

Each spring housing member 4 is capped by an external end cap 2 and a coupling end cap 6. Both types of end cap serve primarily to secure the spring assemblies 24 which float, stacked in a central cylindrical cavity in each spring housing member 4. However, the coupling end cap 6 is designed to also interface with a pulley wheel assembly 8 as depicted in FIG. 1 or alternatively, with another spring housing assembly, which may be added in line.

A grooved metal shaft 32 is inserted centrally along the long axis of the cylindrical cavity in each spring housing 4, and extends from one end of the device to the other; with the shaft ends being held loosely in a center recess in each of the external end caps 2. The shaft 32 directly engages the pulley wheel 92 and a hub 30 of each spring assembly 24 so that a rotation of the pulley wheel 92 will cause all spring assemblies to rotate the same amount. However, unless engaged by a selector lever 16, no resisting force will be generated by a spring assembly 24.

Two end-threaded metal bolts 10 with a winged lock nut on each end, are used as a means of clamping the spring housing assemblies and a pulley assembly 8 together in a column. The winged lock nuts may include a handle portion 12 as illustrated, to aid with tightening or may instead, include a projecting metal ring portion for fastening the device to a fixed, immovable location.

A metal alignment rod 14 closely fills a channel that extends from one external end cap 2 to the device distal external end cap 2, and another identical rod 14 occupies a parallel channel. These channels are formed by through-holes cut in the end caps, the spring housings and the pulley assembly, which are lined up axially during assembly. The alignment rods 14 in the channels, are provided to align each stacked assembly in a precise lateral position that lines up the rotational axis of all rotating components with the central shaft 32, and prevents any possible lateral shifting that might otherwise occur during use of the device and so disrupt operation.

In the FIG. 1 illustration, only half of the spring assemblies 24 in each spring housing member 4 have been selected and the corresponding spring assemblies engaged. This is easily ascertained by observing the selector levers 16 in the slots at the device control face 33. Selector levers 16 that are shown with a long arm edge protruding out of a slot have not been selected. The levers 16 that are shown mostly inside a slot, have been manually selected by pushing the normally protruding lever end inwards with a finger tip.

All the selector levers 16 will have, visibly imprinted on their outer edge, a number indicating the force rating of the spring assembly it will engage. Thus, a user can pick any particular resisting force he desires by pushing the levers that add up to the total force desired. Sequential selection is not required. If each spring assembly is rated differently, the total number of resistance force levels available for selection by a user, increases as the square of the number of spring assemblies that are contained in the device. Thus a device containing only six spring assemblies could have as many as thirty-six resistance force levels available for choice in exercising.

Figure 2:
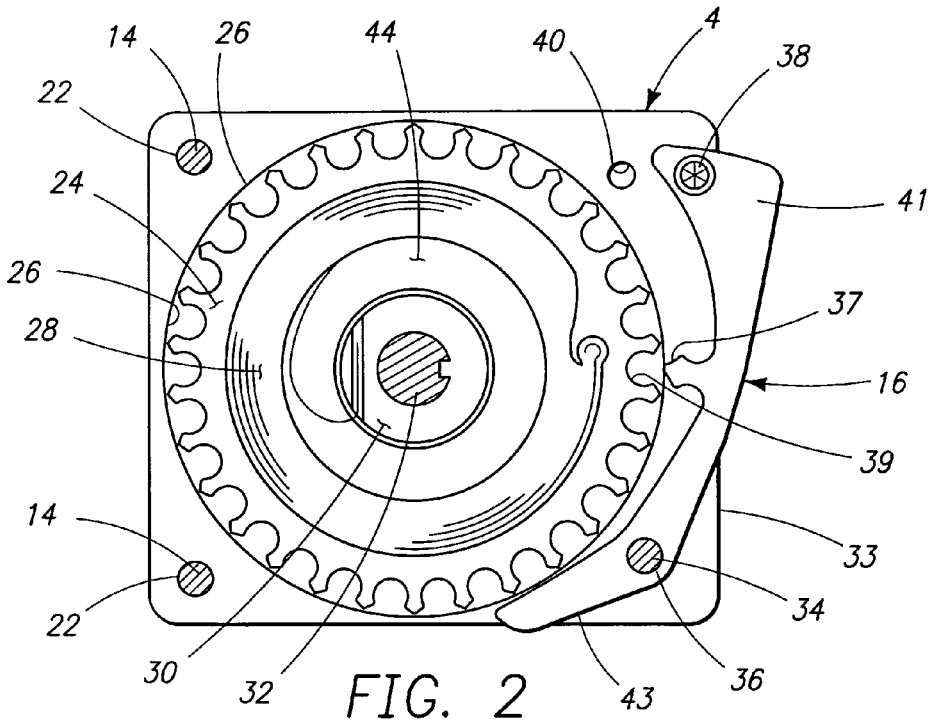
FIGS. 2 and 3 are plan views of a portion of the device taken along the plane defined by line 2—2 of FIG. 1, particularly showing in FIG. 2, an unselected spring assembly and showing in FIG. 3, a spring assembly that is selected and engaged by a selector lever.
Figure 3:
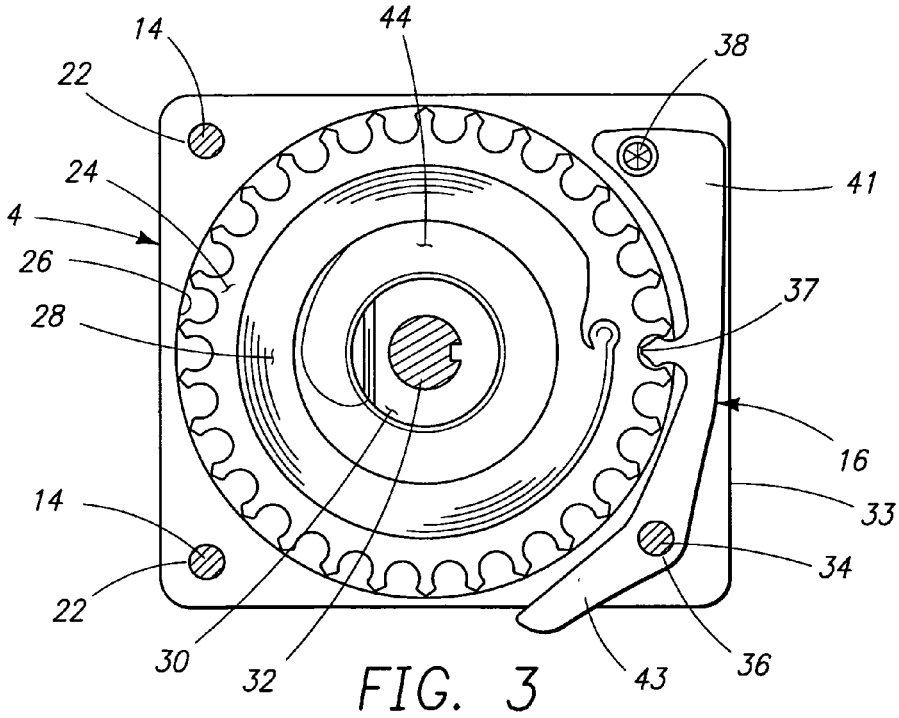

FIGS. 2 and 3, are cross-section views of the device taken along line 2—2 of FIG. 1, and are presented to explain how each spring assembly 24 is engaged by a selector lever 16, and how a constant force is generated by an engaged spring assembly.

These two views show a spring assembly 24 that is fitted in a housing axial cavity 26 at a slot 72 level, and a pivotable selector lever 16 that is mounted on a pivot rod 34 on a slot surface that is adjacent to the control face 33 edge.

In FIG. 2, a spring assembly 24 is shown as unselected and unengaged. The selector lever 16 is shown with its longer arm 41 oriented away from the gear-tooth shaped periphery of the spring assembly 24, so that a projecting spike 37 on the lever 16 can not enter one of the adjacent openings 39 in the spring assembly 24 periphery. In this lever position, a rotation of the axial shaft 32 will start to rotate the keyed hub 30 which fits loosely in the spring base 44. Since one end of the coil-wound spring 28 is held by the hub 30 and the spring base 44 is free to rotate, the spring base will rotate with the hub 30. No significant resisting torque will be generated because the amount of pulling force exerted by the hub on the end of the spring 28 will be minor.

In FIG. 3, a spring assembly 24 is shown as selected and engaged. The longer arm 41 of the selector lever 16 is shown as being oriented closely toward the peripheral spaced teeth around the spring base 44, and the lever spike 37 is received by one of the openings 39 between the peripheral teeth; firmly engaging the spring base 44 and preventing its rotation.

In the selector position shown in FIG. 3, any rotation of the shaft 32 will rotate the hub 30 accordingly which will in turn, pull the hub end of the spring 28 without rotating the spring base 44 which is now held fixed. A constant force torque will thus be generated, with a magnitude depending on the spring 28 rating.

A commonly available means for temporarily holding the long arm 41 of a selector lever 16 in the selected positions, is the use of a spring-loaded snap-in ball 38 mechanism embedded in an end of the lever. This is used together with two separated holes 40 that mark the desired positions in the housing slot surface, to snap the lever easily into the engaged position or disengaged position.

Opening or unselecting a lever is achieved by simply pushing the exposed end of the short arm 43 of a lever inwards until the long arm 41 snaps into the position shown in FIG. 2.

In FIGS. 2 and 3, the housing 4 lineup holes 22 are shown including the alignment rods 14 that are through them. These cross-section figures also illustrate the importance of maintaining an accurate coincidence of the rotation axis for all the stacked rotatable components, hence the need for the use of the alignment rods 14.

Figure 4:
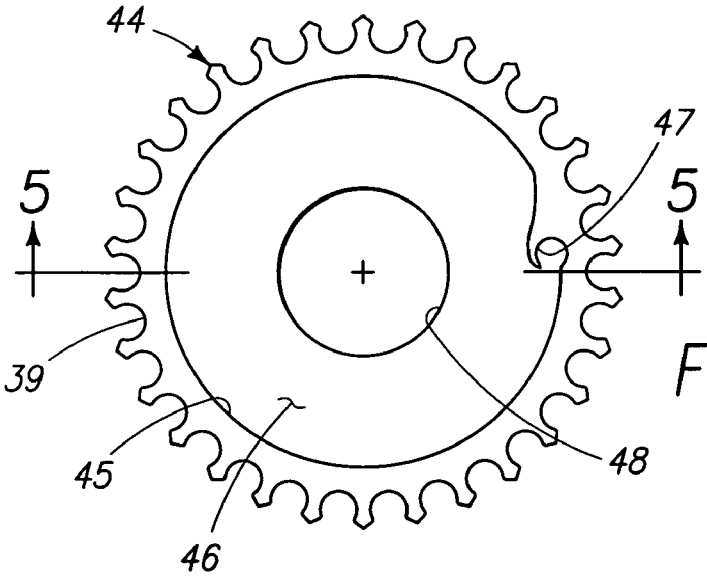
FIGS. 4 and 5 are respectively, a top view of a spring base and a side elevation view taken along line 5—5 of FIG. 4.
Figure 5:
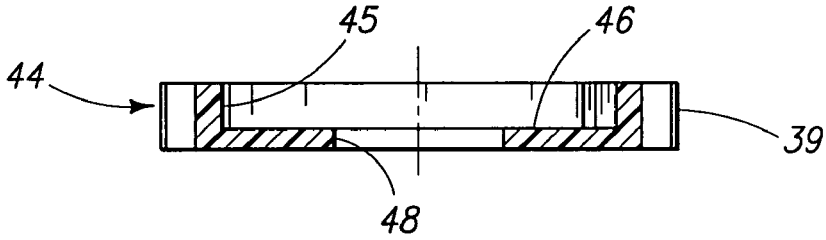

Referring now to FIGS. 4 and 5, there are shown respectively a plan view of a spring base 44 and cross-section view taken along line 5—5 of FIG. 4. The spring base 44 is disc-shaped and made of molded hard plastic, having semi-circular openings 39 in the peripheral edge that are regularly spaced apart all around the edge. These openings 39 in the gear tooth configuration, provide receptacles that are available for catching and retaining a hook portion 37 that projects from the side of a selector lever 16. A generally circular shaped opening 46 is recessed in one side of the spring base for seating a circular-wound constant-force spring 28, while a notched portion 47 in the opening wall 45 provides a means of securing the spring outer end. A circular axial hole 48 is provided to accommodate a rotatable hub 30.

Figure 6:
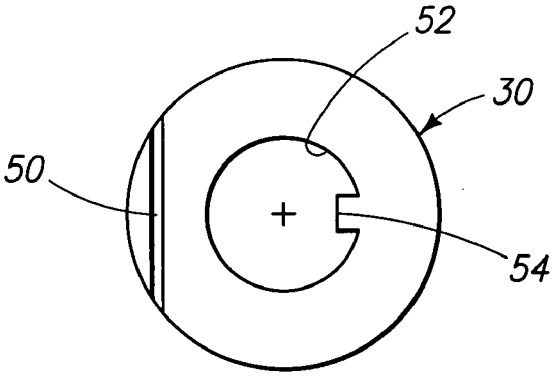
FIGS. 6 and 7 are respectively, an top end view of a spring assembly hub and a side elevation view of the hub.
Figure 7:
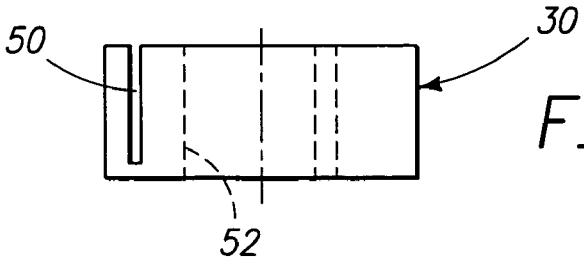

FIGS. 6 and 7 are respectively, an end view and side elevation view of a molded plastic hub 30 which has an outer diameter that is sized to fit the hub loosely in the spring base 44 axial hole 48. The hub 30 includes an axial opening 52 that is sized and shaped to allow the hub to fit slidingly on a central shaft 32 that connects with a pulley 92 in the pulley assembly 8. A radially inward spline 54 in the wall of the opening 52 fits into a longitudinal groove in the shaft 32, locking the hub to the shaft, and a slit 50 provides securing means for an end of a flat-coiled spring.

It should be noted that the height of the hub 30 is made about a third greater than the height or thickness of the spring hub 44. This is done so that when the spring assemblies 24 are stacked on the central shaft 32 inside their housing 4, a rotating spring base surface can not rub against a stationary spring base 44 that may be above or below it, interfering with its free movement.

Figure 8:
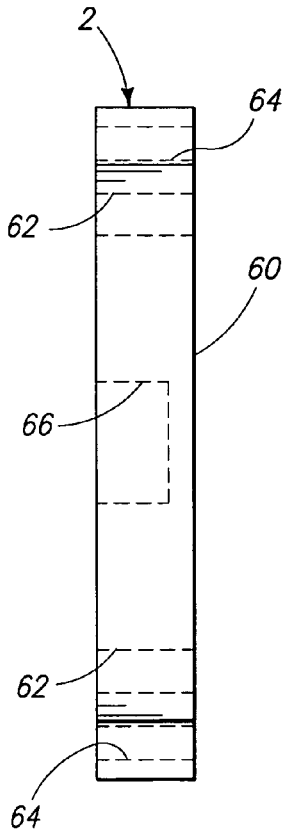
FIGS. 8 and 9 are respectively, a side view and a top plan view of an external end cap which fits on the extreme ends of the device, particularly showing ears and earholes for clamping the device together.
Figure 9:
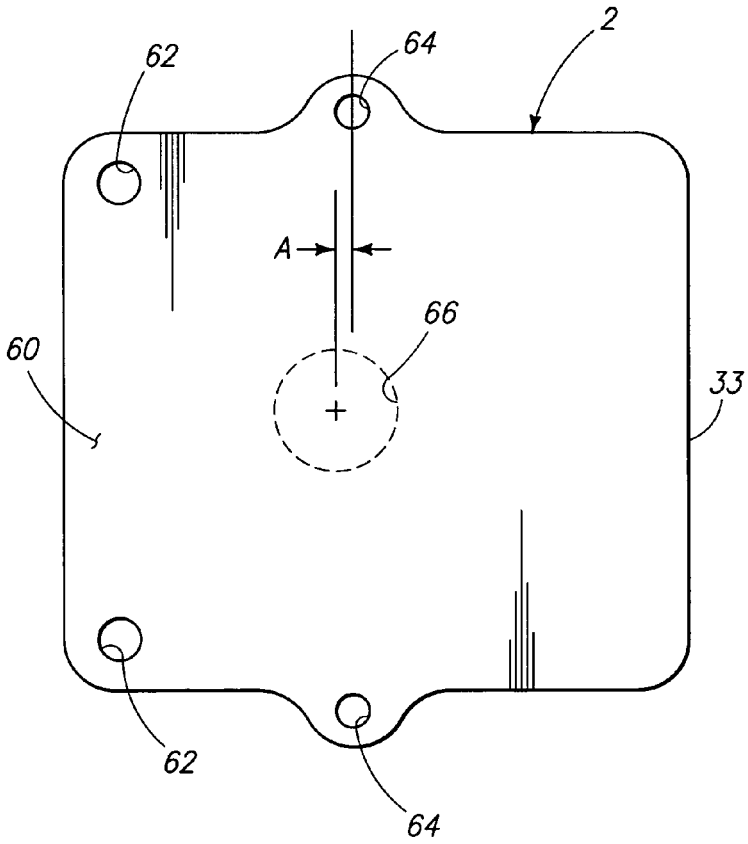

FIGS. 8 and 9 are respectively, a side view and a top, plan view of an external end cap 2. Two through alignment holes 62 are provided in the cap top face 60 to each accommodate an end of an alignment rod 14, and two through holes 64 are provided in opposite side ears to each hold the end of a clamping bolt 16. A circular recess 66 is formed in the underside of the cap which fits against the end surfaces of a spring assembly housing 4 and holds an end of the central shaft 32. The center of the recess 66 must be offset an amount "A" from the cap axis, so that when the end cap is lined up by alignment rods 14 through the housing 4, the cap recess 66 center will coincide with the longitudinal axis of the shaft 32.

Figure 10:
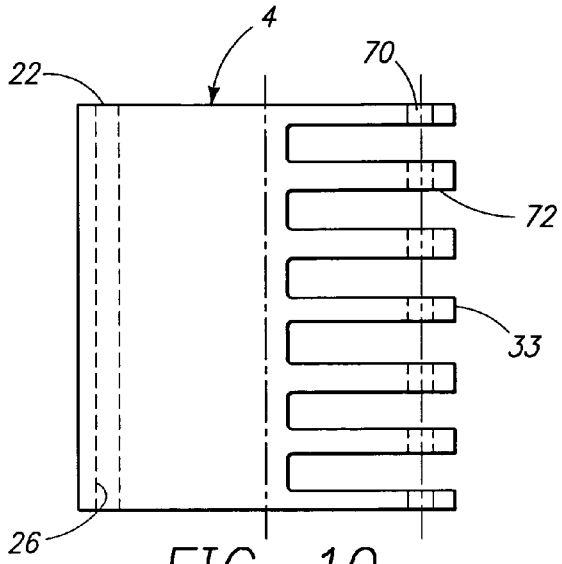
FIGS. 10 and 11 are respectively, a side elevation view and an end view of a spring housing member, particularly showing lateral slots in one side for accessing stored spring assemblies.
Figure 12:
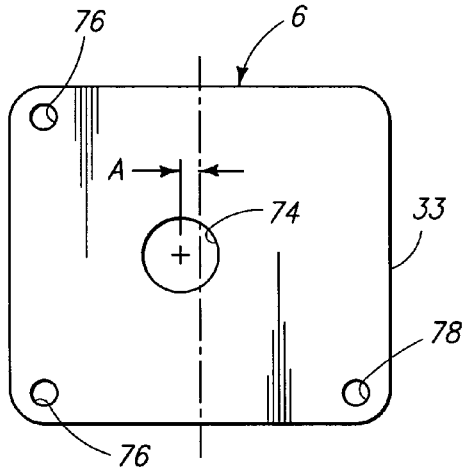
FIGS. 12 and 13 are respectively, a top view and a side elevation view of a coupling end cap that is used to cap an open end of a spring housing assembly for coupling to another assembly.
Figure 11:
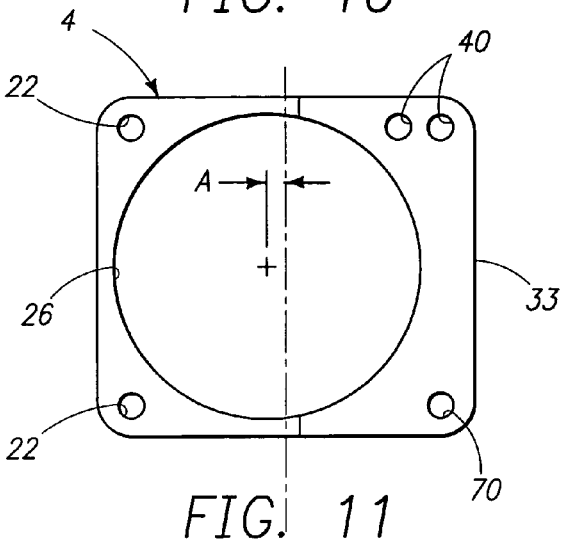
Figure 13:
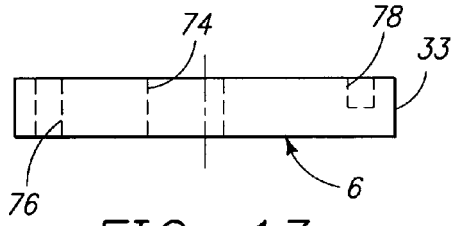

Refer now to FIGS. 10, 11, 12 and 13. FIGS. 10 and 11 are respectively, a side elevation view and an end view of a spring assembly housing 4. FIGS. 12 and 13 are respectively, a plan view and a side elevation view of a coupling end cap 6. The coupling end cap 6 is made to fit on either end of the spring assembly housing 4 and is used to separate the housing 4 from an intermediate in-line assembly such as a pulley assembly 8, which is shown in FIG. 1.

In FIGS. 10 and 11, a cylindrical cavity 26 is shown extending in a spring assembly housing 4 from one end to the other. The longitudinal axis of the cavity 26 is laterally offset an amount "A" to match the position of the shaft 32 axis as measured from the alignment holes 22. A number of horizontal slots 72 are cut in the control face 33 of the housing, and extend inwards sufficiently to permit outside access to a selector lever 16 that will be mounted in each slot 72. A hole 70 is cut through the walls of each slot for a pivot shaft 34 that will pass through each selector lever 16, providing a pivoting means for each lever 16.

As for each of the in-line components, two alignment holes 22 are cut through the spring assembly housing 4, and alignment holes 76 are cut through the coupling end cap 6, for stacking by the alignment rods 14.

In the housing member 4, two holes 40 are cut in the surface of each slot 72, to mate with a spring-loaded snap connector that is on one end of each selector lever 16 in the slot.

In the coupling end cap 6, a central through hole 74 is cut and sized to permit passage of the central shaft 32. The center of the hole 74 is laterally offset an amount "A" to match the position of the shaft axis. As a means of holding one end of the pivot shaft mentioned earlier in the housing description, a recessed hole 78 is provided, located near a corner of the cap 6 in the appropriate position. This, however, may be deemed unnecessary and be omitted, depending on the pivot means used for the selector levers 16.

Figure 14:
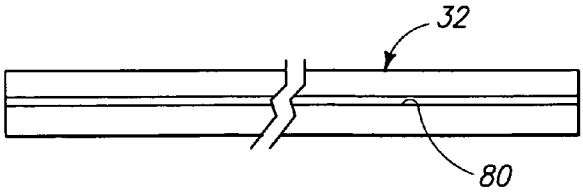
FIGS. 14 and 14A are respectively, a partial, side view and an end view of an elongate metal shaft that is grooved to connect and engage all the rotatable components that are stacked axially in the device.
Figure 14A:
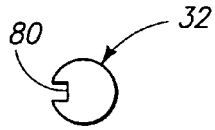

The central shaft 32 is shown in a partial side view in FIG. 14 and end view in FIG. 14A. It is simply a straight metal rod with a deep groove 80 cut along its entire length. This groove 80 is sized to fit closely over the projecting spline of each part that will be placed over the shaft to be rotated by the shaft.

Figure 15:
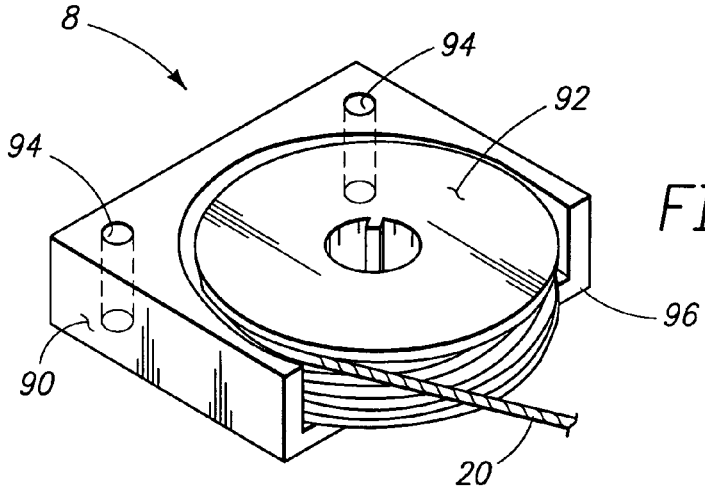
FIG. 15 is a perspective view of a pulley wheel assembly.

Finally, FIG. 15 depicts a perspective view of a pulley wheel assembly 8 that is sized and shaped to fit in line with the spring assembly housings 4 as shown in FIG. 1. The pulley wheel assembly 8 comprises a molded plastic pulley housing 90 and a metal pulley wheel 92 that is wound with a pull cord 20.

Figure 16:
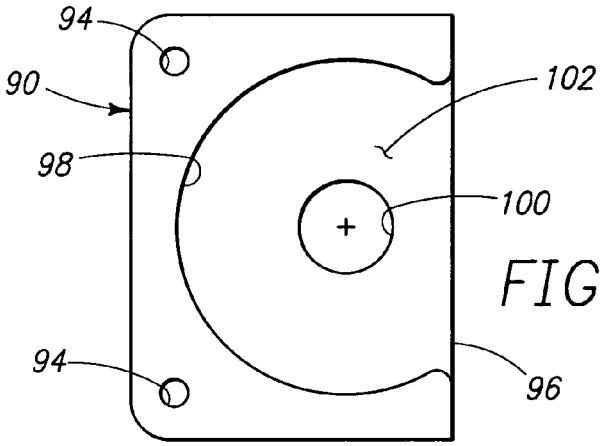
FIGS. 16, 17 and 18 are respectively, a top view, an open side view and a bottom view of pulley wheel holder, particularly showing a semi-circular deep recess for seating a pulley wheel, allowing it to rotate freely.
Figure 17:
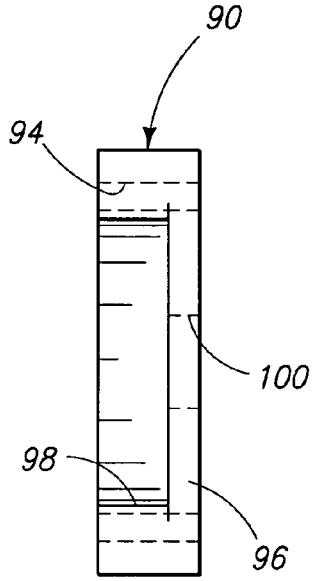
Figure 18:
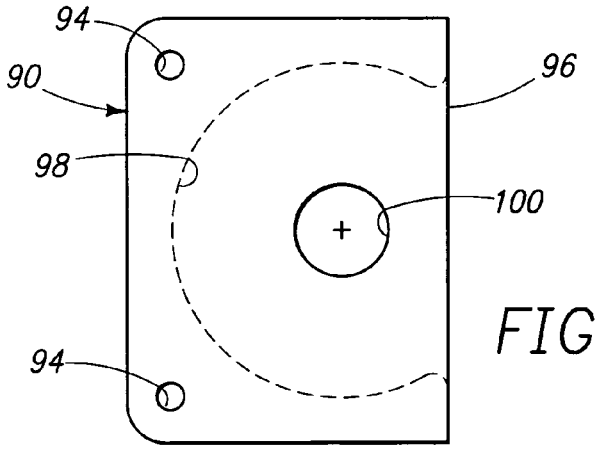

FIGS. 16, 17 and 18 are respectively, a top plan view, a side view as seen looking into a central recessed portion, and a bottom plan view of the pulley housing 90. A semi-circular recessed portion 98 is formed in the top of the housing 90 and sized to fit a wound pulley 92, with clearance for easy pulley rotation. The surface 102 of the recessed portion is flat and smooth for seating the pulley, so that no bearings are needed to assist pulley rotation. A circular axial hole 100 is provided for the central shaft 32 to enter and engage the pulley 92 which is placed in the housing recessed portion. Two holes 94 are provided in the pulley housing for the insertion of locating rods 14 when the assembly is stacked in line in the exerciser device.

It should be noted that the pulley wheel housing front side 96 which will be close to the device control face 33, has been cut back so that a substantial portion of a seated pulley wheel 92 will extend out of the pulley wheel housing as seen in FIG. 15. This is done to allow as much angular variation and play of the pull cord with respect to the device as is possible, exerted by an exerciser user.

Referring once more to the invention embodiment shown in FIG. 1, it should be noted that there are a considerable number of variations that can be made to this device, without affecting its basic principals of construction or mode of operation. For example, the device cross-section need not be rectangular as depicted. Since the device itself does not rotate, the device stacked body may be curved in any desirable shape, so long as a linear internal column construction is maintained and direct access to the selector levers 16 is provided. This fact opens possible usage of the invention to hand held use by individuals ranging from children to elderly adults for exercising.

The number of spring assembly housings 4 in a device may be as low as one or even four or more. Two or more pulley assemblies may be incorporated. The size, ratings and quantity of spring assemblies contained in a device are all variable. Thus a large number of device configurations, having the same basic characteristics of the present invention can be envisioned for various applications. From the foregoing, it is clear that the use and versatility of the original pulling device are greatly enhanced by the present invention.

Most of the device parts are fabricated from hard, molded plastic. Metal components used are few, consisting of the central shaft, two clamping bolts, the constant-force springs the pulley wheel, and two alignment rods. With the exception of the central shaft, all the metal parts are standard and can be readily purchased.

As compared, with the earlier design pulling device, there are no expensive, machined parts required, and far fewer parts in the total assembly. The ease of device assembly is obvious from the foregoing description. Therefore, manufacture of the device in quantity, should result in a much lower cost per invention device as compared with the earlier pulling exerciser device, and will be welcomed by potential users.

From the foregoing description, it is believed that the described preferred embodiment achieves the objects of the present invention. Alternative embodiments and modifications will be apparent to those skilled in the art. These and other modifications are considered to be equivalent and within the spirit and scope of the present invention.

Having described the invention, what is claimed is:

1. An athletic exerciser pulling apparatus, comprising in combination:

(a) a plurality of spring housing assemblies; each spring housing assembly comprising: a multiplicity of circular, constant force spring assemblies; an elongate housing member made of molded hard plastic and including a cylindrical bore having a longitudinal axis extending from one end to a distal end, said bore being sized in diameter to permit stacking said spring assemblies therein; a first end cap and a second end cap made of molded hard plastic for capping both open ends of said housing member; and means for manually selected engagement of one or more said spring assemblies by a user, as a spring resisting force;

said spring assemblies each comprising a constant-force coiled spring; a generally disc shaped, molded plastic base having a coaxial, deep circular recessed portion that is sized to seat said spring, cut in one face of said base, leaving a wide rim around said base, said rim having a multiplicity of edge openings that are spaced equidistantly apart around said rim for the purpose of engaging said base; said recessed portion having a flat bottom surface which includes a concentric first hole for holding a hub, said recessed portion also including means for fastening an external end of said spring thereto; and a molded plastic hub that is sized to rotate freely inside said first hole, said hub having a concentric second hole for sliding along a central shaft, said second hole including a spline that extends radially inwards for engaging said shaft, said hub including a deep slit in one face for retaining one end of said spring;

said housing member including a multiplicity of lateral slots cut in one longitudinal face to equal the number of spring assemblies that are stacked inside said bore, said longitudinal face with said lateral slots cut therein, defining a control face for accessing and selecting any spring assembly for engagement; said slots being cut to a depth that provides access to said bore through each slot, said slots each being located a distance apart so that each slot faces a peripheral edge of a spring assembly in said housing member;

said first end cap being a thick, rigid flat plate which is shaped and sized to match an end of said housing member, said plate including two ears, one projecting on each of two parallel edges, each ear having an earhole for use in clamping said first end cap to an end of said housing member, said plate having a deep, circular recess cut in the surface of one flat side, said recess being located so that it is concentric with the longitudinal axis of said bore in said housing member when placed on an end of said housing member;

said second end cap being a thick, rigid flat plate which is sized and shaped to fit on an end of said housing member, said plate having a centrally located third hole cut through, said third hole being located so that it is concentric with said bore in said housing member when placed on an end of said housing member, said second end cap acting to couple a pulley wheel assembly to a housing member;

(b) a pulley wheel assembly comprising a rigid plastic, tray-like holder, a metal pulley wheel that fits in said holder, and a pull handle that is attached to a cord which is wound around said pulley wheel; said holder being shaped and sized to fit against a flat surface of said second end cap, and including a semicircular shaped deep cavity in which said pulley wheel is seated, with part of said pulley wheel extending over an open side edge of said holder, said holder including a fourth hole for allowing passage of a central shaft;

(c) means for clamping said spring housing assemblies and said pulley wheel assembly together in a column, when said pulley wheel assembly is held between the second end caps of two spring housing assemblies; said pulley wheel assembly being oriented so that said pulley wheel in said holder extends with its pull cord in the open space created between the ends of said spring housing assemblies at said control face of said apparatus; and, (d) an elongate metal shaft having a longitudinal groove extending from one end of said shaft to a distal shaft end, said shaft being disposed along the longitudinal axis of the bores in said spring housing assemblies and through the hub of said pulley wheel, engaging the hubs of all rotatable components that are contained in said apparatus;

said pulling apparatus operating in the following manner: manually pulling said pull handle rotates the pulley wheel, causing the central shaft to rotate the hubs of all contained spring assemblies and thereby to rotate also the bases and contained springs of unselected assemblies; however selected spring assemblies will have their bases engaged by said first means for selected engagement, and be prevented from rotating, generating a resisting force that is created by a rotating hub pulling one end of a fixed position coiled spring.

2. An athletic exerciser pulling apparatus according to claim 1 wherein said means for manually selected engagement of one or more said spring assemblies includes a selector lever which is pivotally mounted in each lateral slot in said control face of said housing member; said selector lever comprising a flat, long arm portion and a short arm portion that are joined forming an elongated "C" shape with a pivot hole cut in the area joining the two arm portions; said long arm portion including a pointed projection with hook edges that is located approximately at a midpoint along said arm portion, and which points inward toward the rim of a spring assembly when a selector lever is mounted; said pointed projection entering an opening in the rim of said spring assembly, and engaging said spring assembly when said selector lever is manually pushed at a long portion end, toward said slot.

3. The apparatus according to claim 2 including means for removably locking a selector lever in an unengaged position or in an engaged position with a spring assembly; said unengaged position being indicated externally by the protrusion of an end of said long arm portion of said selector lever.

4. An athletic exerciser pulling apparatus according to claim 1 wherein said hub in a spring assembly is made about a third greater in height than the overall thickness of said base which it serves; said hub, when in place at the center of said base, extending above the uppermost surface and below the under surface of said base, preventing any adjacent stacked spring assembly from rubbing against said base and interfering with normal operation.

5. An athletic exerciser pulling apparatus according to claim 1 wherein said means for clamping said spring housing assemblies and said pulley wheel assembly together in a column includes two elongate metal bolts with threaded ends and two pairs of lock nuts, said lock nuts each having an extension portion shaped as a handle or a fastening ring; each bolt, on opposite sides of said column, being passed through a hole in an ear of a first end cap at one end of said column, and through an earhole in a first end cap at a distal end of said column; said lock nuts then being placed on each protruding threaded end of said bolts and tightened in place, clamping said column together securely.

6. An athletic exerciser pulling apparatus according to claim 1, including means for ensuring accurate axial alignment of all stacked components with said shaft in said column at all times; said means for ensuring accurate axial alignment includes having two through holes, located a distance apart, longitudinally through said housing members, said end caps and said pulley wheel assembly; said through holes being located at the same lateral distance from the longitudinal axis of said bore in said housing members and the axis of said pulley wheel in said pulley wheel assembly;

and two rigid, metal rods, each metal rod being tightly disposed in said through holes, and extending from one end of said column to a distal end, ensuring that the stacked assemblies are accurately aligned axially and can not slip laterally out of alignment at any time.

7. An athletic exerciser pulling apparatus, comprising in combination:

(a) a multiplicity of spring housing assemblies; each spring housing assembly comprising: a multiplicity of circular, constant force spring assemblies; an elongate housing member made of molded hard plastic and including a cylindrical bore having a longitudinal axis extending from one end to a distal end, said bore being sized in diameter to permit stacking said spring assemblies therein; a first end cap and a second end cap made of molded hard plastic for capping both open ends of said housing member; and means for manually selected engagement of one or more said spring assemblies by a user, as a spring resisting force;

said spring assemblies each comprising a constant-force coiled spring; a generally disc shaped, molded plastic base having a coaxial, deep circular recessed portion that is sized to seat said spring, cut in one face of said base, leaving a wide rim around said base, said rim having a multiplicity of edge openings that are spaced equidistantly apart around said rim for the purpose of engaging said base; said recessed portion having a flat bottom surface which includes a concentric first hole for holding a hub, said recessed portion also including means for fastening an external end of said spring thereto; and a molded plastic hub that is sized to rotate freely inside said first hole, said hub having a concentric second hole for sliding along a central shaft, said second hole including a spline that extends radially inwards for engaging said shaft, said hub including a deep slit in one face for retaining one end of said spring;

said housing member including a multiplicity of lateral slots cut in one longitudinal face to equal the number of spring assemblies that are stacked inside said bore, said longitudinal face with said lateral slots cut therein defining a control face for accessing and selecting any spring assembly for engagement; said slots being cut to a depth that provides access to said bore through each slot, said slots each being located a distance apart so that each slot faces a peripheral edge of a spring assembly in said housing member;

said first end cap being a thick, rigid flat plate which is shaped and sized to match an end of said housing member, said plate including two ears, one projecting on each of two parallel edges, each ear having an earhole for use in clamping said first end cap to an end of said housing member, said plate having a deep, circular recess cut in the surface of one flat side, said recess being located so that it is concentric with said bore in said housing member when placed on an end of said housing member;

said second end cap being a thick, rigid flat plate which is sized and shaped to fit on an end of said housing member, said plate having a centrally located third hole cut through, said third hole being located so that it is concentric with said bore in said housing member when placed on an end of said housing member, said second end cap acting to couple one spring housing assembly with a pulley-wheel assembly or with another spring housing;

(b) a plurality of pulley wheel assemblies, each pulley wheel assembly comprising a rigid plastic, tray-like holder, a metal pulley wheel that fits in said holder, and a pull handle that is attached to a cord which is wound around said pulley wheel, said pulley wheel having a fixed hub that includes a spline in an axial hole for engaging with a grooved shaft; said holder being shaped and sized to fit against a flat surface of said second end cap, and including a semicircular shaped deep cavity in which said pulley wheel is seated, with part of said pulley wheel extending over an open side edge of said holder, said holder including a fourth hole for allowing passage of a central shaft;

(c) means for clamping said spring housing assemblies and said pulley wheel assemblies together in a column; each pulley wheel assembly being oriented so that said pulley wheel in said holder extends with its pull cord in an open space created between the ends of said spring housing assemblies at said control face of said apparatus; and, (d) an elongate metal shaft having a longitudinal groove extending from one end of said shaft to a distal shaft end, said shaft being disposed along the longitudinal axis of the bores in said spring housing assemblies and through the hub of each said pulley wheel, engaging the hubs of all rotatable components that are contained in said apparatus;

said pulling apparatus operating in the following manner: manually pulling said pull handle rotates the pulley wheel to which the pull handle is attached by a cord, causing the central shaft to rotate the hubs of all contained spring assemblies and thereby to rotate also the bases and contained springs of unselected assemblies; however selected spring assemblies will have their bases engaged by said means for selected engagement, and be prevented from rotating, generating a resisting force that is created by a rotating hub pulling one end of a fixed position coiled spring.

8. An athletic exerciser pulling apparatus according to claim 7 wherein said means for manually selected engagement of one or more said spring assemblies that are contained in a housing member includes a selector lever which is pivotally mounted in each lateral slot in said control face of said housing member; said selector lever comprising a flat, long arm portion and a short arm portion that are joined forming an elongated "C" shape with a pivot hole cut in the area joining the two arm portions; said long arm portion including a pointed projection with hook edges that is located approximately at a midpoint along said arm portion, and which points inward toward the rim of a spring assembly when a selector lever is mounted; said pointed projection entering an opening in the rim of said spring assembly, and engaging said spring assembly when said selector lever is manually pushed at a long portion end, toward said slot.

9. The apparatus according to claim 8 including means for removably locking a selector lever in an unengaged position or in an engaged position with a spring assembly; said unengaged position being indicated externally by the protrusion of an end of said long arm portion of said selector lever.

10. An athletic exerciser pulling apparatus according to claim 7 wherein said hub in a spring assembly is made about a third greater in height than the overall thickness of said base which it serves; said hub, when in place at the center of said base, extending above the uppermost surface and below the under surface of said base, preventing any adjacent stacked spring assembly from rubbing against said base and interfering with normal operation.

11. An athletic exerciser pulling apparatus according to claim 7 wherein said means for clamping said spring housing assemblies and said pulley wheel assemblies together in a column includes two elongate metal bolts with threaded ends and two pairs of lock nuts, said lock nuts each having an extension portion shaped as a handle or a fastening ring; each bolt, on opposite sides of said column, being passed through a hole in an ear of a first end cap at one end of said column, and through an earhole in a first end cap at a distal end of said column; said lock nuts then being placed on each protruding threaded end of said bolts and tightened in place, clamping said column together securely.

12. An athletic exerciser pulling apparatus according to claim 1, including means for ensuring accurate axial alignment of all stacked components with said shaft in said column at all times; said means for ensuring accurate axial alignment includes having two through holes, located a distance apart, longitudinally through said housing members, said end caps and said pulley wheel assemblies; said through holes being located at the same lateral distance from the longitudinal axis of said bore in said housing members and the axis of said pulley wheel in said pulley wheel assembly;

and two rigid, metal rods, each metal rod being tightly disposed in said through holes, and extending from one end of said column to a distal end, ensuring that the stacked assemblies are accurately aligned axially and can not slip laterally out of alignment at any time.

* * * * *